United States Patent [19]

Shaub

[11] 4,376,711

[45] Mar. 15, 1983

[54] LUBRICANT COMPOSITION

[75] Inventor: Harold Shaub, New Providence, N.J.

[73] Assignee: Exxon Research and Engineering Co., Florham Park, N.J.

[21] Appl. No.: 942,621

[22] Filed: Sep. 15, 1978

Related U.S. Application Data

[63] Continuation-in-part of Ser. No. 931,666, Aug. 7, 1978, abandoned, which is a continuation-in-part of Ser. No. 791,284, Apr. 27, 1977, abandoned, which is a continuation-in-part of Ser. No. 707,495, Jul. 22, 1976, abandoned.

[51] Int. Cl.[3] ..... C10M 1/26

[52] U.S. Cl. ..... 252/32.7 E; 252/46.6; 252/56 S

[58] Field of Search ..... 252/32.7 E, 56 S, 56 R; 260/446

[56] References Cited

U.S. PATENT DOCUMENTS

| | | | |
|---|---|---|---|
| 2,564,423 | 8/1951 | Barnum | 252/56 R X |
| 2,580,036 | 12/1951 | Matuszek et al. | 252/56 R X |
| 2,911,367 | 11/1959 | Baus et al. | 252/32.7 E |
| 2,976,122 | 3/1961 | Ertelt et al. | 252/32.7 E |
| 3,152,990 | 10/1964 | Coppock et al. | 252/32.7 E |
| 3,180,832 | 4/1965 | Furey | 252/56 S |
| 3,281,356 | 10/1966 | Coleman | 252/32.7 E |
| 3,429,817 | 2/1969 | Furey et al. | 252/56 S |
| 3,513,094 | 5/1970 | Farmer et al. | 252/32.7 E |
| 3,803,037 | 4/1974 | Wygart | 252/32.7 E |
| 3,933,659 | 1/1976 | Lyle et al. | 252/32.7 E |
| 3,981,810 | 9/1976 | Bolster | 252/32.7 E |
| 3,984,599 | 10/1976 | Norton | 252/32.7 E |
| 4,010,106 | 3/1977 | Rothert | 252/32.7 E |
| 4,010,107 | 3/1977 | Rothert | 252/32.7 E |

FOREIGN PATENT DOCUMENTS

| | | | |
|---|---|---|---|
| 1284512 | 8/1972 | United Kingdom | 252/32.7 E |

*Primary Examiner*—Jacqueline V. Howard

*Attorney, Agent, or Firm*—Eugene Zagarella, Jr.

[57] ABSTRACT

An additive combination comprising a hydroxysubstituted ester of a polycarboxylic acid and a metal dihydrocarbyl dithiophosphate and lubricating compositions comprising the same. The lubricating compositions comprising these additives exhibit improved antifriction and anti-wear properties. Best results are achieved when the ester is obtained from a dimer acid and particularly a dimer of a fatty acid containing conjugated unsaturation. The metal used in the metal dialkyl dithiophosphate must be one having a relatively soft metal oxide and particularly a metal oxide having a Mohs hardness of about 3 or less.

14 Claims, No Drawings

LUBRICANT COMPOSITION

CROSS-REFERENCE TO RELATED APPLICATIONS

This application is a continuation-in-part of co-pending U.S. application Ser. No. 931,666 filed Aug. 7, 1978, now abandoned, which is a continuation-in-part of U.S. application Ser. No. 791,284 filed Apr. 27, 1977, now abandoned, and which in turn is a continuation-in-part of U.S. application Ser. No. 707,495 filed July 22, 1976 and now abandoned.

BACKGROUND OF THE INVENTION

This invention relates to additives for liquid hydrocarbons and to liquid hydrocarbon compositions containing the same. More particularly, this invention relates to a multi-component additive mixture and to lubricating compositions comprising the same.

As is well known, there are many instances, particularly under "Boundary Lubrication" conditions where two rubbing surfaces must be lubricated, or otherwise protected, so as to prevent wear and to ensure continued movement. Moreover, where, as in most cases, friction between the two surfaces will either increase the power required to effect the movement or reduce the recovery efficiency, where the movement is an integral part of an energy conversion system, it is most desirable to effect the lubrication in a manner which will minimize this friction. As is also well known, both wear and friction can be reduced, with various degrees of success, through the addition of a suitable additive or combination thereof, to a natural or synthetic lubricant. Similarly, continued movement can be insured again with varying degrees of success, through the addition of one or more appropriate additives.

With respect to wear, several suitable additives have been proposed heretofore. In general, these additives function by forming a protective coating on the moving surfaces. Moreover, these additives are, generally, only slightly soluble in the base oil medium and are, therefore, easily separated from the oil at the moving surfaces. Generally, the antiwear agent coating is maintained through physical, rather than chemical, bonding. In this regard, it should be noted that reaction products obtained by reacting a polyhydroxy compound with certain fatty acid and particularly dimers and trimers of unsaturated fatty acids, such as those disclosed in U.S. Pat. Nos. 3,180,832 and 3,429,817, are included in the list of such additives which are well known in the prior art.

Extreme pressure agents, on the other hand, also form a protective coating on the surface of the moving metal parts thereby preventing metal to metal contact even when the base lubricating oil is effectively squeezed from between the surfaces. These coatings are, however, generally effected through chemical bonding and are, therefore, generally more stable than the coatings formed by antiwear agents. Metal dialkyl dithiophosphates are, of course, included amongst the list of extreme pressure agents known to be effective in the prior art.

Similarly, antifriction agents or oiliness or lubricity agents as the same are often referred to in the prior art functioned by forming a coating on the surface of the moving metal parts. As in the case of antiwear agents, however, the coating bonds are, generally, effected physically, rather than chemically, and, indeed, the bonding between an antifriction agent and the surface is, generally weaker than the bond formed between an antiwear agent and the metal surface. Notwithstanding this, however, the polyols derived by reacting a polyhydroxy compound with a fatty acid and particularly dimers of unsaturated fatty acids, such as those taught in U.S. Pat. Nos. 3,180,832 and 3,429,817, are known to reduce the friction between moving metal surfaces.

As is also well known in the prior art, and as is suggested by the foregoing, antiwear, antifriction and extreme pressure agents, as well as other agents, compete for the surface of the moving metal parts which are subjected to lubrication with a given composition and, indeed, extreme care must, generally, be exercised in the selection of these several agents to ensure compatibility and effectiveness. As is equally well known, several additives which are commonly used in lubricating compositions perform multiple function. As a result, several known compositions will contain more than one additive exhibiting antiwear properties, more than one additive exhibiting antifriction properties and more than one additive exhibiting extreme pressure properties.

Representative of the multifunctional additives are the metal dialkyl dithiophosphates which, among other things, exhibit antioxidant properties and antiwear properties. Of these compounds, the zinc dialkyl dithiophosphate are most commonly used in lubricant compositions and, while zinc dialkyl dithiophosphate affords excellent oxidation resistance and exhibits superior antiwear properties, the same appears to increase the friction between the moving surfaces. As a result, compositions containing zinc dialkyldithiophosphate as well as other metal dialkyl dithiophosphates where the metal forms a relatively hard metal oxide do not offer the most desirable lubricity and, in turn, lead to significant energy losses in overcoming friction even when antifriction agents are included in the composition. Such lubricant compositions do, then, generally, result in higher fuel consumption than is considered particularly desirable, especially in light of the current energy crisis.

In light of the foregoing, then, the need for an improved lubricating composition that will permit operation of moving parts under boundary conditions with reduced friction is believed to be readily apparent. Similarly, the need for such a composition that can be used without the loss of other desirable lubricant properties is also believed to be readily apparent.

SUMMARY OF THE INVENTION

It has now surprisingly been discovered that the foregoing and other disadvantages of the prior art lubricating additives and the lubricating compositions formulated therewith can be overcome with the additive combination and the lubricating compositions obtained therewith of this invention. It is, then, an object of a first embodiment of this invention to provide a combination of lubricating additives which will reduce friction when used in a lubricating oil composition under boundary lubricating conditions. It is another object of this first embodiment of the invention to provide such a combination of additives which can be used with still other lubricating additives to provide a lubricating composition which will exhibit acceptable antiwear, extreme pressure, anticorrosion and antioxidation properties. It is, on the other hand, an object of a second embodiment of this invention to provide an improved lubricating oil composition which can be used under boundary lubricating conditions. It is still another object of this second embodiment of the invention to provide such a composition exhibiting improved antifriction properties. It is a still further object of this second embodiment of the invention to provide such a composition which will, generally, reduce fuel requirements for engines and other equipment having moving parts operated under boundary lubricating conditions. Still further objects will become apparent from the description set forth hereinafter.

In accordance with the present invention, the foregoing and other objects and advantages are accomplished with a combination of additives comprising at least one hydroxy-substituted ester of a polycarboxylic acid and at least one metal dihydrocarbyl dithiophosphate. As indicated more fully, hereinafter, the hydroxy-substituted ester will contain at least one radical which is carefully selected so as to provide the solubility desired for the particular, intended application. As also indicated more fully hereinafter, the metal portion of the metal dihydrocarbyl dithiophosphate will be one which would form a relatively soft metal oxide and the alkyl radicals will be carefully selected so as to provide the desired solubility for the intended use.

DETAILED DESCRIPTION OF THE INVENTION

As previously indicated, the present invention relates to a unique lubricating additive combination and to lubricating compositions comprising these additives. More specifically, the present invention relates to an improved additive composition which exhibits synergistic antifriction characteristics and to lubricating oil compositions comprising the same. As also indicated previously, the additive combination of the present invention comprises a hydroxy-substituted ester of a polycarboxylic acid and a metal dialkyl dithiophosphate.

In general, any hydroxy substituted oil soluble ester of a polycarboxylic acid could be used in the additive combination of this invention. Best results are, however, obtained when such compounds are derived from the esterification of a polycarboxylic acid with a glycol. Such an ester may be a partial, di- or polyester with typical formulas of the ester represented by the following general formulas:

$$HO—R—OOC—R''—COOH \quad (1)$$

$$HO—R—OOC—R''—COOR'—OH \quad (2)$$

$$HO—R—OOC—R''—COOR—OOC—R''—COOR'—OH \quad (3)$$

wherein R'' is the hydrocarbon radical of said acid and each R and R' may be the same or different hydrocarbon radicals associated with a glycol or diol as hereinafter defined. It will, of course, be appreciated that esters of the type illustrated by the foregoing formulas can be obtained by esterifying a polycarboxylic acid, or a mixture of such acids, with a diol or mixture of such diols.

The polycarboxylic acid used in preparing the ester may be an aliphatic saturated or unsaturated acid and will generally have a total of about 24 to about 90, preferably about 24 to about 60 carbon atoms and about 2 to about 3, preferably about 2 carboxylic acid groups with at least about 9 up to about 42 carbon atoms, preferably about 12 to about 42 and more preferably about 16 to about 22 carbon atoms between the carboxylic acid groups.

The oil insoluble glycol which is reacted with the polycarboxylic acid may be an alkane diol, i.e. alkylene glycol or an oxa-alkane diol, i.e. polyalkylene glycol, straight chain or branched. The alkane diol may have from about 2 to about 12 carbon atoms and preferably about 2 to about 5 carbon atoms in the molecule and the oxa-alkane diol will, generally, have from about 4 to about 200, preferably about 4 to about 100 carbon atoms. The oxa-alkane diol (polyalkylene glycol) will, of course, contain periodically repeating groups of the formula:

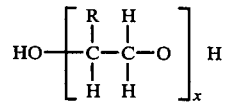

wherein R may be H, $CH_3$, $C_2H_5$ or $C_3H_7$, and x is 2 to 100, preferably 2 to 25. The preferred alkane diol or alkylene glycol is ethylene glycol and the preferred oxa-alkane diol or polyalkylene glycol is diethylene glycol.

While any of the esters as set forth above can be effectively used, best results are, however, obtained with such compounds wherein the carboxyl groups of the polycarboxylic acid are separated from each other by from about 16 to about 22 carbon atoms and wherein the hydroxy group are separated from the closest carboxyl group by from about 2 to about 12 carbon atoms. Particularly desirable results have been obtained with additives prepared by esterifying a dimer of a fatty acid particularly those containing conjugated unsaturation with a polyhydroxy compound. Such dimers are, of course, clearly taught in U.S. Pat. No. 3,180,832 which was granted on Apr. 27, 1965 and U.S. Pat. No. 3,429,817 which was granted on Feb. 25, 1969, and as there indicated, the hydrocarbon portion of the dimer or dicarboxylic acid thus obtained may contain a six member ring. The formation of the dimer from linoleic acid, oleic acid and mixtures of these acids is illustrated by the following:

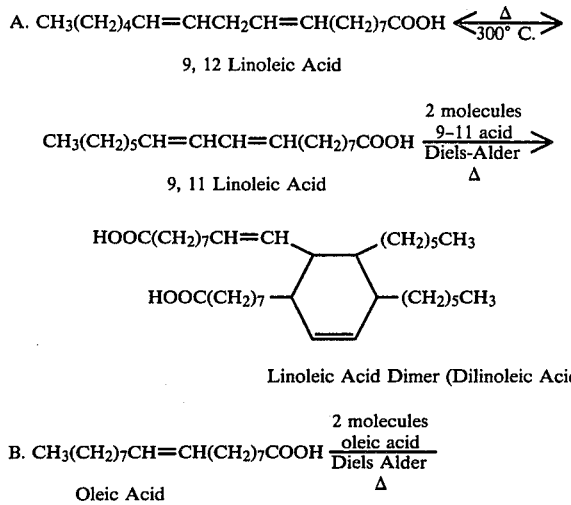

-continued $$\begin{array}{l} CH_3(CH_2)_7CH{=}C(CH_2)_7COOH \\ \quad\quad\quad\quad\quad\quad\quad\quad | \\ CH_3(CH_2)_7CH_2CH(CH_2)_7COOH \end{array}$$

Oleic Acid Dimer (Dioleic Acid)

$$\text{C 9,11 Linoleic Acid} + \text{Oleic Acid} \xrightarrow[\Delta]{\text{Diels-Alder}}$$

$$\begin{array}{l} CH_3(CH_2)_6CHCH{=}CH(CH_2)_7COOH \\ \quad\quad\quad\quad\quad\quad | \\ CH_3(CH_2)_4CHCH{=}CHCH{=}CH(CH_2)_7COOH \end{array}$$

Mixed Dimer

It will, of course, be appreciated that while the reactions illustrated produces the dimers, commercial application of the reactions will, generally, lead to trimer formation and in some cases the product thus obtained will contain minor amounts of unreacted monomer or monomers. As a result, commercially available dimer acids may contain as much as 25% trimer and the use of such mixtures is within the scope of the present invention.

The preferred hydroxy-substituted ester lubricity additives useful in the present invention will be the reaction product of a dimerized fatty acid, such as those illustrated, and an oil insoluble glycol and may be produced by various techniques. As previously pointed out, the preferred acid dimers are the dimers of linoleic acid, oleic acid or the mixed dimer of linoleic and oleic acids, which may also contain some monomer as well as trimer. Other specifically satisfactory glycols in addition to ethylene glycol and polyethylene glycol are, for example, propylene glycol, polypropylene glycol, butylene glycol, polybutylene glycol and the like.

The metal dihydrocarbyl dithiophosphates useful in the present invention are salts of dihydrocarbyl esters of dithiophosphoric acids and may be represented generally by the following formula:

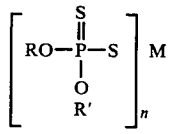

wherein R and R′ may be the same or different hydrocarbon radicals containing between about 1 and about 18 carbon atoms; M is a transition metal; and n is the valence of the metal M. As indicated previously, M may be any metal which forms a relatively soft metal oxide and for purposes of this invention a metal oxide will be considered relatively soft if the oxide exhibits a Mohs hardness of about 3 or less. Such metals, then, include antimony, bismuth, arsenic, molybdenum and cadmium.

The dihydrocarbyl dithiophosphates which are useful in the compositions of the present invention may be prepared in accordance with known techniques by first esterifying a dithiophosphoric acid and the neutralizing the dithiophosphoric acid ester with a suitable metal salt. In general, any alcohol or mixtures of alcohols containing between about 1 and 18 carbon atoms may be used to effect the esterification. The hydrocarbon portion of the alcohol may be either a straight chain alkyl or alkenyl group, or a cyclic, cycloaliphatic or aromatic group with the alkyl group being particularly preferred. Among the alcohols which are generally preferred for use as starting materials in the preparation of the esters may be mentioned ethyl, isopropyl, amyl, 2-ethylhexyl, lauryl, steryl and methyl cyclohexyl alcohols as well as commercial mixtures of alcohols such as the mixture of alcohols essentially of the $C_{10}$ to $C_{18}$ range derived from coconut oil and known as "Lauryl B" alcohol. Other natural products containing alcohols such as the alcohols derived from wool fat, spun oil, natural waxes and the like and alcohols produced by the oxidation of petroleum hydrocarbon products, also the oxo-alcohols produced from olefins, carbon monoxide and hydrogen may likewise be employed. Aromatic compounds such as alkylated phenols of the type of N-butyl phenol, tertiary-amyl phenol, diamyl phenol, tertiary octyl phenol, cetyl phenol, petroleum phenol and the like as well as the corresponding naphthols may be employed in like manner.

Following the esterification, the diester is then neutralized with a suitable basic metal compound or a mixture of such compounds. In general, any compound could be used but the oxides, hydroxides and carbonates are most generally employed.

In general, the hydroxy substituted esters useful in the additive combination and lubricating compositions of the present invention can also be prepared in accordance with methods well known in the prior art, and, indeed, the same may be prepared in situ in a manner taught in U.S. Pat. No. 3,180,832. Preparation prior to combination in a fully formulated lubricating composition is, however, preferred since reaction with other additives will be avoided in this way. In either case, however, the acid and alcohol will generally be combined in a stoichiometric ratio; i.e., 1 mole of alcohol or hydroxyl group per mole of carboxyl group, so as to insure complete esterification without excessive condensation of hydroxy terminated ester with unesterified acid. In this regard, it should be noted that when the polyol concentration, during preparation, is less than stoichiometric some such condensation will occur and, indeed, can be tolerated, especially where a higher molecular weight additive is required. When the alcohol concentration is in excess of stoichiometric, on the other hand, such condensation would, normally be avoided. Typically, molar quantities of the polycarboxylic acid and glycol reactants will vary from about 1 to about 3 or more moles of glycol per mole of acid and preferably from about 1 to about 2 moles of glycol per mole of acid.

In general, the hydroxy-substituted esters will be combined in a lubricating composition at a concentration within the range from about 0.01 to about 1.0 parts by weight per 100 parts of base oil, preferably from about 0.1 to about 1.0 and more preferably about 0.1 to about 0.5 and the metal neutralized dihydrocarbyl dithiophosphate will be added at a concentration within the range of from about 0.01 to about 5.0 parts by weight per 100 parts of base oil, preferably about 0.1 to about 5.0 and more preferably from about 0.5 to about 1.5. Moreover, the weight ratio of metal neutralized dihydrocarbyl dithiophosphate to hydroxy-substituted ester will generally be maintained within the range from about 6 to about 25 in such compositions.

Among the liquid hydrocarbons which may be used as base oils comprising the major proportion of the lubricating composition are mineral lubricating oils or synthetic lubricating oils. The synthetic oils will include diester oils such as di(2-ethylhexyl) sebacate; complex ester oils such as those formed from dicarboxylic acids, glycols and either monobasic acids or monohydric alcohols; silicone oils; sulfide esters; organic carbonates; and other synthetic oils known to the art. Warming the oil and additive materials may be necessary in order to obtain solution if the additives are solid at normal temperature.

Other additives, of course, may be added to the oil compositions of the present invention to form a finished oil. Such additives include dispersants such as PIBSA-TEPA, etc., oxidation inhibitors such as phenothiazine or phenyl α-naphthylamine; rust inhibitors such as lecithin or petroleum sulfonates; sorbitan monooleate; detergents such as the barium phenates; pour point depressants such as copolymers of vinyl acetate with fumaric acid esters of coconut oil alcohols; viscosity index improvers such as olefin copolymers, polymethacrylates; etc.

As previously indicated, the additive combination of the present invention can be used with other additives and, indeed, such additives will generally be used in fully formulated lubricating compositions. Since the metal neutralized dihydrocarbyl dithiophosphates used in the present invention would compete with similar neutralized salts of metals forming relatively hard oxides, however, it is preferred that the concentration of metal salts of metals forming hard oxides in fully formulated compositions be maintained at relatively low values and most preferred that the same not be used in formulations where maximum antifriction is desired.

PREFERRED EMBODIMENT

In a preferred embodiment of the present invention, the hydroxy-substituted ester will be the reaction product of a linoleic acid dimer and a glycol containing between about 2 and 5 carbon atoms or a polyglycol prepared from one of these glycols. In a most preferred embodiment, diethylene glycol will be used. Also in a preferred embodiment of the present invention, an antimony dialkyl dithiophosphate will be used and the alkyl portions will be either the same or different and either straight chained or branched chained groups containing between about 2 and 8 carbon atoms. In a most preferred embodiment, the alkyl portions of the dialkyldithiophosphate will be provided through esterification with a $C_3$ alcohol.

In a preferred lubricating composition, the hydroxy substituted ester and the antimony neutralized dialkyl dithiophosphate will be combined with a mineral oil suitable for use as a lubricant in an internal combustion engine. In the preferred composition the hydroxy substituted ester will be added at a concentration ranging from about 0.1 to about 0.5 parts per 100 parts of base oil while the antimony neutralized dialkyl dithiophosphate will be added at a concentration within the range from about 0.5 to about 1.5 parts per 100 parts of base oil. In a most preferred composition, the lubricant will be fully formulated and contain an oxidation inhibitor, a rust inhibitor, a detergent, a dispersant, a pour point depressant and a viscosity index improver.

The invention will be further understood by reference to the following examples which illustrate a preferred form of the invention and compares the same with different, though similar compositions.

EXAMPLE 1

In this example, four formulations were prepared in a 10W-40 SE quality automotive engine oil and the relative wear and friction were then determined with a ball on cylinder test. The apparatus used in the ball on cylinder test is described in the Journal of the American Society of Lubrication Engineers, entitled "ASLE Transactions" vol. 4, pages 1–11, 1961. In essence, the apparatus consists basically of a fixed metal ball loaded against a rotating cylinder. The weight on the ball and the rotation of the cylinder can be varied during any given test or from test to test. Also, the time of any given test can be varied. Generally, however, steel on steel is used at a constant load, a constant rpm and a fixed time and in each of the tests of this example, a 4 Kg load, 0.26 rpm and 120 minutes was used. The actual wear was determined by measuring the volume of metal removed from the cylinder and then placed on a relative basis by ratioing the wear actually obtained against a standard. The actual friction, on the other hand, was determined from the power actually required to effect rotation and the relative friction determined by ratioing the actual load to that of a standard. The apparatus and method used is more fully described in U.S. Pat. No. 3,129,580, which was issued May 21, 1964 to Furey et al and which is entitled "Apparatus For Measuring Friction and Contacts Between Sliding Lubricating Surfaces".

In this example, the standard was a 10W-40 SE quality automotive engine oil containing a dispersant, a rust inhibitor, a detergent, an oxidation inhibitor and a V.I. improver and a zinc dialkyl dithiophosphate in which the alkyl groups were a mixture of such groups having between about 4 and 5 carbon atoms. The wear and friction of this composition were then determined and assigned a relative value of 1.00.

In a second composition, the same formulated 10W-40 SE quality automotive engine oil was used and an antimony phosphorodithioate substituted for the zinc dialkyl dithiophosphate. Again, the alkyl group of the antimony neutralized salt contained about 3 carbon atoms. The wear and friction of this composition were then determined and, on a relative basis and found to be 0.90 and 0.75, respectively.

In a third composition, the same formulated 10W-40 SE quality automotive engine oil was used, the same amount of the same antimony phosphorodithioate was included and 0.1 grams of a hydroxy terminated dimer acid of linoleic acid which can be represented by the following formula:

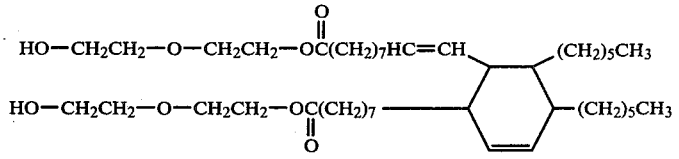

This ester was prepared by esterifying the dimer acid with diethylene glycol. After formulation, the wear and friction were determined and, on a relative basis were 0.64 and 0.56, respectively.

The fourth composition tested in this example was identical to that set forth above, except that the zinc dialkyl dithiophosphate used in the first composition was substituted for the antimony phosphorodithioate. After formulation, the wear and friction were again determined in the same manner as that previously described and were found to be 0.70 and 0.44, respectively. There was, however, a rapid deterioration of this oil, precipitation was detected and both wear and friction increased significantly after about 400 hours. This, then, suggests that the hydroxy substituted ester of linoleic acid dimer is incompatible with zinc dialkyl dithiophosphate.

From the foregoing, it should be readily apparent that the substitution of an antimony dialkyl dithiophosphate for a zinc dialkyl dithiophosphate in a fully formulated 10W-40 SE quality automotive engine oil improves both wear and friction. Moreover, the addition of hydroxy terminated dimer acid of linoleic acid further reduces both wear and friction when coupled with the antimony phosphorodithioate and the same is compatible therewith. The good results initially observed with the hydroxy substituted ester in combination with the zinc dialkyl dithiophosphate, on the other hand, rapidly deteriorated.

EXAMPLE 2

In this example, the friction of several lubricating compositions was determined with a ball on cylinder test with a load of 4 Kg, a temperature of 220° F., 0.26 rpm and a period of 70 minutes. In each formulation, a solvent 150 Neutral, low pour base oil was used and the base oil without additives was assigned a relative friction of 1.

In the first composition, 1.5 wt. % of a zinc dialkyl dithiophosphate identical to that used in Example 1 was added to the base oil. The relative friction was then found to be 0.89.

In a second formulation, 1.5 wt. % of an antimony dialkyl dithiophosphate, identical to that used in Example 1 was added to the base oil. The relative friction of this composition was 0.41.

In a third composition, 0.1 wt. % of a hydroxy terminated linoleic acid dimer ester, identical to that used in Example 1 was added to the base oil. The relative friction of this composition was 0.55.

In a fourth composition, 1.5 wt. % of a zinc dialkyl dithiophosphate, identical to that used in the previous examples, and 0.1 wt. % of the hydroxy terminated dimer acid ester, identical to that used in previous examples, was added to the base oil. The relative friction of this composition was 0.62.

In a fifth composition, 1.5 wt. % of an antimony dialkyl dithiophosphate, identical to that used in previous examples, and 0.1 wt. % of a hydroxy terminated ester of linoleic acid, identical to that used in previous examples, was added to the solvent 150 Neutral low pour base oil. The relative friction of this composition was 0.38.

From the foregoing, it should again be clear that the friction of an unformulated base oil is significantly reduced when an antimony dialkyl dithiophosphate is substituted for a zinc dialkyl dithiophosphate. Similarly, it is clear that the addition of a hydroxy terminated ester of linoleic acid will further reduce the friction when the same is combined with an antimony dialkyl dithiophosphate. In this regard, it is significant that the relative friction of the fifth composition is significantly less than the relative friction of either the second or third composition. In the unformulated base oil, on the other hand, the addition of the hydroxy terminated ester to a base oil containing a zinc dialkyl dithiophosphate did not significantly reduce the friction and, indeed, the value obtained is within the realm of that which would be expected from a comparison of compositions 1 and 3.

What is claimed is:

1. A lubricating oil composition comprising a base oil, from about 0.01 to about 1.0 parts by weight of an hydroxy-substituted ester of a polycarboxylic acid with a glycol per 100 parts of base oil, said acid having a hydrocarbon portion containing from about 9 to about 42 carbon atoms between carboxyl groups and said glycol is selected from the group consisting of alkylene glycols having from about 2 to about 12 carbon atoms and polyalkylene glycols having from about 4 to about 200 carbon atoms and from about 0.01 to about 5.0 parts by weight, per 100 parts of base oil, of a metal dialkyl dithiophosphate, wherein the alkyl portion of said metal dialkyl dithiophosphate contains between about 1 and about 18 carbon atoms and said metal is a metal whose oxide exhibits a Mohs hardness of about 3.0 or less.

2. The composition of claim 1 wherein the metal in said metal dialkyl dithiophosphate is selected from the group consisting of antimony, bismuth, arsenic, molybdenum and cadmium.

3. The composition of claim 1 wherein the metal in said metal dialkyl dithiophosphate is antimony.

4. The composition of claim 1 wherein from about 0.1 to about 1.0 parts by weight of said ester and from about 0.1 to about 5.0 parts by weight of said metal dialkyl dithiophosphate is used.

5. The composition of claim 4 wherein said acid has a hydrocarbon portion containing from about 16 to about 22 carbon atoms between carboxyl groups and said polyalkylene glycols have from about 4 to about 100 carbon atoms.

6. The composition of claim 1 wherein said hydroxy substituted ester is the ester of a glycol and the dimer of a conjugated fatty acid.

7. The composition of claim 5 wherein said alkyl groups in said metal dialkyl dithiophosphate contain between about 2 and 8 carbon atoms.

8. The composition of claim 7 wherein said hydroxy substituted ester is the ester of a glycol and the dimer of a conjugated fatty acid.

9. The composition of claim 8 wherein the metal in said metal dialkyl dithiophosphate is selected from the group consisting of antimony, bismuth, arsenic, molybdenum and cadmium.

10. The composition of claim 1 wherein the metal in said metal dialkyl dithiophosphate is antimony.

11. The composition of claim 10 wherein from about 0.1 to about 0.5 parts by weight of said ester and from about 0.5 to about 1.5 parts by weight of said metal dialkyl dithiophosphate is used.

12. The composition of claim 4 wherein said acid is the dimer acid of linoleic acid, oleic acid or the mixed dimer of linoleic and oleic acids and said glycol is ethylene glycol or diethylene glycol.

13. The composition of claim 9 wherein said glycol is an alkylene glycol having from about 2 to about 5 carbon atoms.

14. The composition of claim 9 wherein said glycol is ethylene glycol or diethylene glycol and said dimer acid is the dimer of linoleic acid, oleic acid or the mixed dimer of linoleic and oleic acids.

* * * * *